US011027321B2

(12) United States Patent
Beyer

(10) Patent No.: US 11,027,321 B2
(45) Date of Patent: Jun. 8, 2021

(54) DEVICE FOR SCRAPING DEBRIS FROM METAL WIRE

(71) Applicant: FORD MOTOR COMPANY, Dearborn, MI (US)

(72) Inventor: Timothy George Beyer, Troy, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 16/360,710

(22) Filed: Mar. 21, 2019

(65) Prior Publication Data

US 2019/0217356 A1 Jul. 18, 2019

Related U.S. Application Data

(63) Continuation of application No. 14/807,089, filed on Jul. 23, 2015, now Pat. No. 10,279,384.

(51) Int. Cl.

| | |
|---|---|
| ***B08B 9/04*** | (2006.01) |
| ***B21C 43/04*** | (2006.01) |
| ***C23C 4/12*** | (2016.01) |
| ***B08B 9/043*** | (2006.01) |

(52) U.S. Cl.

CPC ..... *B21C 43/04* (2013.01); *B08B 9/0436* (2013.01); *C23C 4/12* (2013.01)

(58) Field of Classification Search

CPC ..... B08B 1/02; B08B 9/0436; B21C 43/04

See application file for complete search history.

(56) References Cited

U.S. PATENT DOCUMENTS

| | | | |
|---|---|---|---|
| 2,578,229 | A | 12/1951 | Clement |
| 2,703,512 | A | 3/1955 | Brookes |
| 3,600,790 | A | 8/1971 | Dion |
| 3,782,154 | A | 1/1974 | Fuchs, Jr. |
| 4,454,657 | A | 6/1984 | Yasumi |

(Continued)

FOREIGN PATENT DOCUMENTS

| | | | |
|---|---|---|---|
| CN | 201982274 | U | 9/2011 |
| CN | 102468594 | A | 5/2012 |

OTHER PUBLICATIONS

English translation of CN102468594A dated May 23, 2012.

(Continued)

*Primary Examiner* — Michael D Jennings

(74) *Attorney, Agent, or Firm* — Vincent Mastrogiacomo; King & Schickli, PLLC

(57) ABSTRACT

A device and related method for removing debris from a metal wire formed by a process utilizing a lubricant is provided. The device includes at least two segments forming a passage through which the wire passes, each having a leading edge for stripping debris from the wire, and a resilient member positioned around the at least two segments and applying a force to the segments sufficient to cause contact between the leading edges and at least the debris on the metal wire passing through the passage. The method broadly includes the steps of moving the metal wire through a passage formed by a plurality of segments, contacting the wire moving through the passage using a leading edge of each of the at least two segments, and applying a force to the at least two segments to cause contact between the leading edge of each of the at least two segments and at least the debris on the wire passing through the passage.

11 Claims, 4 Drawing Sheets

(56) References Cited

U.S. PATENT DOCUMENTS

| | | | | |
|---|---|---|---|---|
| 4,650,380 | A | 3/1987 | Lipowski | |
| 4,799,300 | A | 1/1989 | Phillips | |
| 5,121,573 | A | 6/1992 | Vassena | |
| 5,265,338 | A | 11/1993 | Cheng | |
| 5,653,027 | A | 8/1997 | Wall | |
| 5,661,865 | A * | 9/1997 | Humphrey | B44D 3/006 15/3 |
| 5,870,792 | A * | 2/1999 | Shurtliff | B08B 1/04 15/102 |
| 6,334,253 | B1 | 1/2002 | Cheng | |
| 7,335,050 | B2 | 2/2008 | Kirk et al. | |
| 7,913,394 | B2 | 3/2011 | Hager | |
| 8,683,641 | B2 | 4/2014 | Weinberger et al. | |
| 9,557,132 | B2 * | 1/2017 | Williams | B08B 9/0436 |
| 2003/0136171 | A1 | 7/2003 | Goto | |
| 2004/0012244 | A1 * | 1/2004 | Waterman | B60B 7/02 301/37.101 |
| 2005/0045699 | A1 * | 3/2005 | Konishi | B21C 1/02 228/214 |
| 2006/0123876 | A1 | 6/2006 | Zelin | |
| 2011/0061434 | A1 | 3/2011 | Krintzline et al. | |
| 2012/0103044 | A1 | 5/2012 | Takagi et al. | |
| 2013/0061443 | A1 | 3/2013 | Fengler et al. | |
| 2013/0228047 | A1 | 9/2013 | Yang | |
| 2014/0338195 | A1 | 11/2014 | Zhao | |

OTHER PUBLICATIONS

English translation of CN201982274U dated Sep. 21, 2011.
Office Action dated Dec. 19, 2018 for CN Application No. 2016105739004 filed Jul. 19, 2016.
Office Action dated Feb. 2, 2017 for U.S. Appl. No. 14/807,089, filed Jul. 23, 2015.
Office Action dated Aug. 14, 2017 for U.S. Appl. No. 14/807,089, filed Jul. 23, 2015.
Office Action dated Apr. 17, 2018 for U.S. Appl. No. 14/807,089, filed Jul. 23, 2015.

* cited by examiner

DEVICE FOR SCRAPING DEBRIS FROM METAL WIRE

This application claims the benefit of U.S. patent application Ser. No. 14/807,089, (now U.S. Pat. No. 10,279,384), filed Jul. 23, 2015, the disclosure of which is incorporated herein by reference.

TECHNICAL FIELD

This document relates generally to wire cleaning devices, and more specifically to a multi segment device used to scrape debris from metal wire.

BACKGROUND

It is well known that the process of forming metal wire, commonly referred to as wire drawing, uses lubricants. Wire drawing is a metalworking process used to reduce a cross-section of a wire by pulling the wire through a single, or series of, drawing die(s). The process for drawing wire is relatively simple. First, the wire is prepared by shrinking a first end by hammering, filing, rolling or swaging, so that the wire will fit through the die. Second, the wire is pulled through the die. As the wire is pulled through the die, a volume of the wire remains the same. So, as the diameter of the wire decreases, the length of the wire increases.

Lubrication in the drawing process is essential for maintaining a good surface finish and extending the useful life of the die(s). Different methods of lubrication include, for example, wet drawing where the die(s) and wire are completely immersed in lubricant, dry drawing where the wire passes through a container of lubricant which coats the surface of the wire, and metal coating where the wire is coated with a soft metal which acts as a solid lubricant. The lubricants can include, for example, liquid lubricants such as an oil or copper (II) sulfate solution, or dry film lubricants among many others. Regardless of the type of lubricant utilized in the wire drawing process used to form the metal wire, lubricants can attract debris which adheres to the wire. Processes utilizing the metal wire which are sensitive to such debris can be negatively affected by the presence of the debris. One such process is the manufacturing of vehicles.

Accordingly, a need exists for a simple and inexpensive way to overcome issues related to the use of lubricants in the wire drawing process used to form metal wire. Ideally, the debris adhered to the metal wire due to the presence of the lubricant can be stripped from the metal wire. It would be desirable if a device could be utilized to strip the debris from the metal wire. Even more, it would be desirable if the metal wire being stripped did not require threading through the stripping device.

SUMMARY OF THE INVENTION

In accordance with the purposes and benefits described herein, a device for removing debris from a metal wire formed by a process utilizing a lubricant includes at least two segments forming a passage through which the metal wire passes, each of the at least two segments having a leading edge for stripping debris from the metal wire, and a resilient member positioned around the at least two segments and applying a force to the at least two segments sufficient to cause contact between the leading edges and the metal wire passing through the passage.

In one possible embodiment, the at least two segments form a substantially tubular passage. In another possible embodiment, the leading edge of each of the at least two segments substantially conforms to an outer diameter of the wire.

In still another possible embodiment, an inner surface of each of the at least two segments substantially conforms to an outer diameter of the wire. In yet another, the inner surface of each of the at least two segments is a wear resistant material attached to each of the at least two segments.

In another possible embodiment, the leading edge for stripping debris from the metal wire is in the shape of one of a small radius, a large radius, substantially no radius, a positive break, or a negative break.

In still another possible embodiment, the metal wire includes an outer protective coating and the force applied to the at least two segments is insufficient to scrape the outer protective coating from the wire.

In still yet another possible embodiment, the resilient member is one of a spring clamp, a snap ring, an O-ring, a spring, or an elastic band. In another, first and second ends of the resilient member are connected to create the force applied to the at least two segments.

In a second possible embodiment, a device for removing debris from a metal wire formed by a process utilizing a lubricant, includes at least two segments forming a passage through which the metal wire passes, each of the at least two segments having a leading edge for stripping debris from the metal wire, and first and second side edges, and a resilient member positioned around and applying a force to the at least two segments. In this embodiment, a first side edge of a first segment is connected to a second side edge of a second segment and a gap between a second edge of the first segment and a first edge of the second segment opens wide enough to allow the metal wire to pass therethrough for positioning of the metal wire within the passage.

In another possible embodiment, the force applied by the resilient member closes the gap after the metal wire is positioned within the passage and causes contact between at least the leading edges of the at least two segments and the metal wire passing through the passage.

In still another possible embodiment, the first side edge of the first segment and the second side edge of the second segment are hingedely connected.

In yet another possible embodiment, the leading edge of each of the at least two segments substantially conforms to an outer diameter of the wire.

In a third possible embodiment, a method of removing debris from a metal wire formed by a process utilizing a lubricant, includes the steps of: moving the metal wire through a passage formed by a plurality of segments; contacting the metal wire moving through the passage using a leading edge of each of the plurality of segments; and applying a force to the plurality of segments to cause contact between the leading edge of each of the plurality of segments and the metal wire passing through the passage.

In another possible embodiment, the method further includes the step of moving the metal wire through at least one straightener following the step of moving the metal wire through the passage formed by the plurality of segments.

In still another possible embodiment, the moving step includes pulling the metal wire from a roll of metal wire through the at least one straightener and the passage formed by the plurality of segments.

In yet another possible embodiment, the passage formed by the plurality of segments is fixed in position such that the metal wire moving through the passage is moving substantially horizontal.

In yet still another possible embodiment, the method further includes the step of collecting the debris removed from the metal wire in a container positioned beneath the leading edges of the plurality of segments.

In the following description, there are shown and described several embodiments of a device and related method for removing debris from a metal wire formed by a process utilizing a lubricant. As it should be realized, the devices and methods are capable of other, different embodiments and their several details are capable of modification in various, obvious aspects all without departing from the methods and assemblies as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the device and method and together with the description serve to explain certain principles thereof. In the drawing figures.

Figure 4:
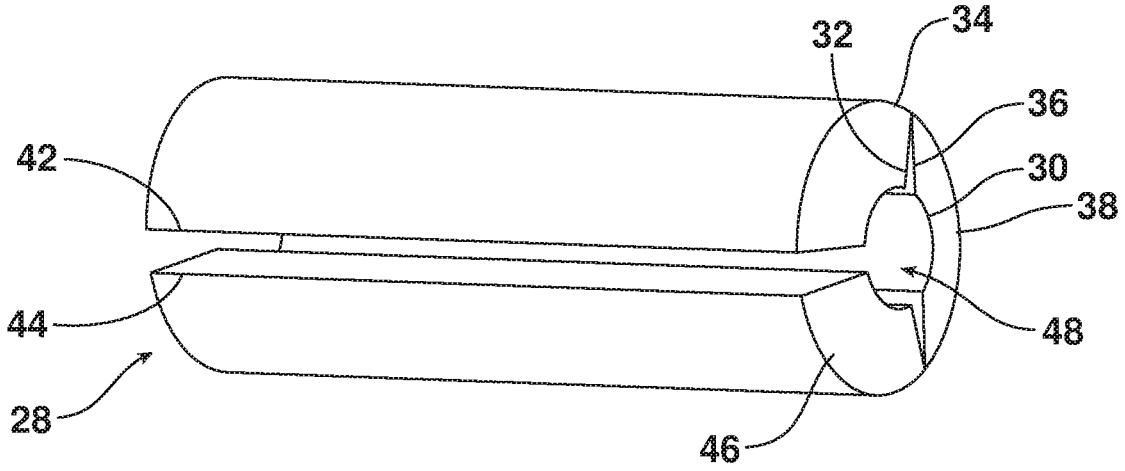
Figure 5:
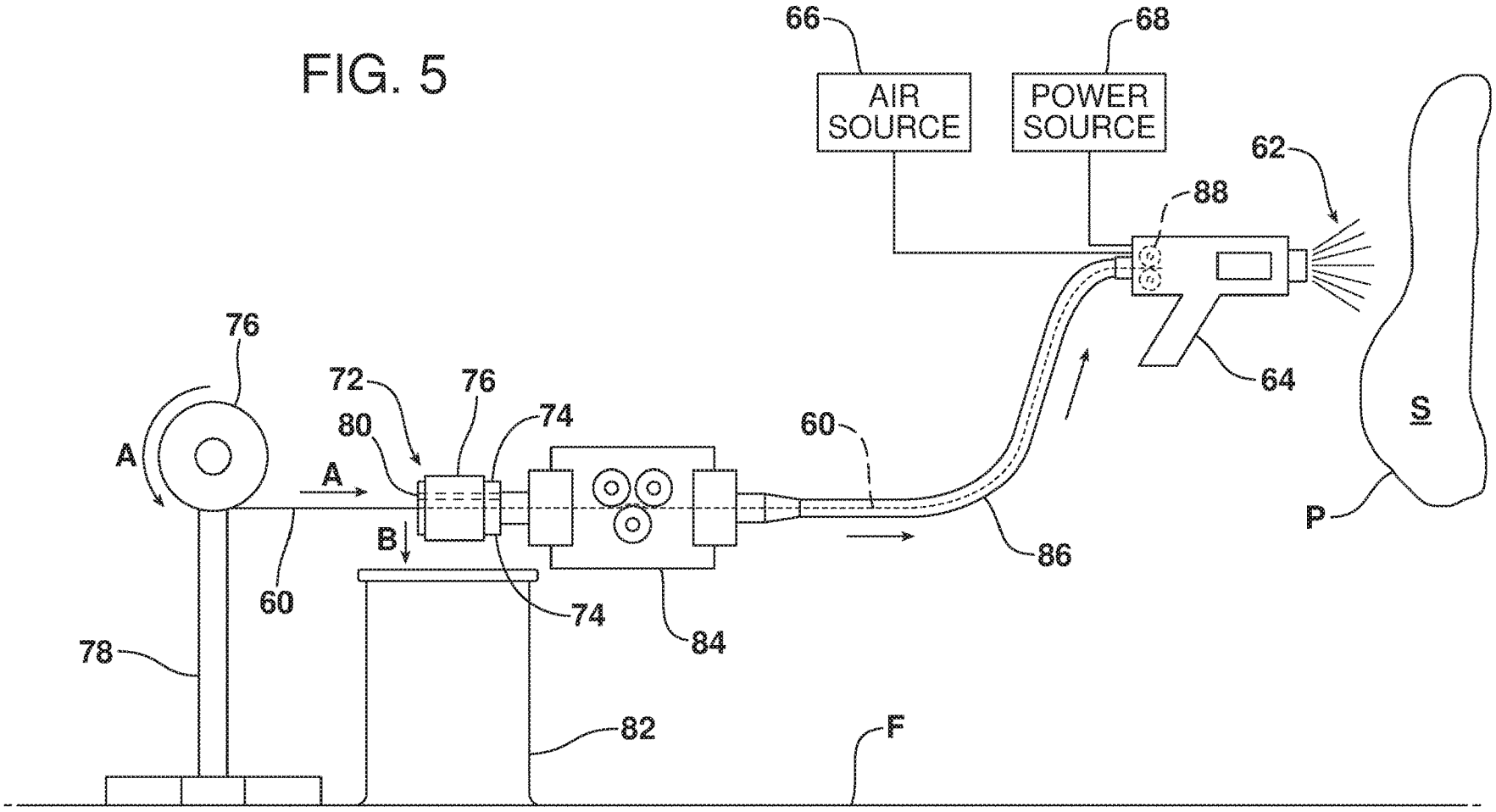

FIG. 4 is a perspective view of a device for stripping debris from a metal wire showing sides of segments of the device connected one to another except for a gap between two such sides which gap is utilized to position the metal wire within the device for stripping debris from the metal wire; and FIG. 5 is an illustration of thermal spraying process within which the device for removing debris from a metal wire may be utilized.

Reference will now be made in detail to the present preferred embodiments of the device and related method for removing debris from a metal wire formed by a process utilizing a lubricant, examples of which are illustrated in the accompanying drawing figures, wherein like numerals are used to represent like elements.

DETAILED DESCRIPTION

Figure 1:
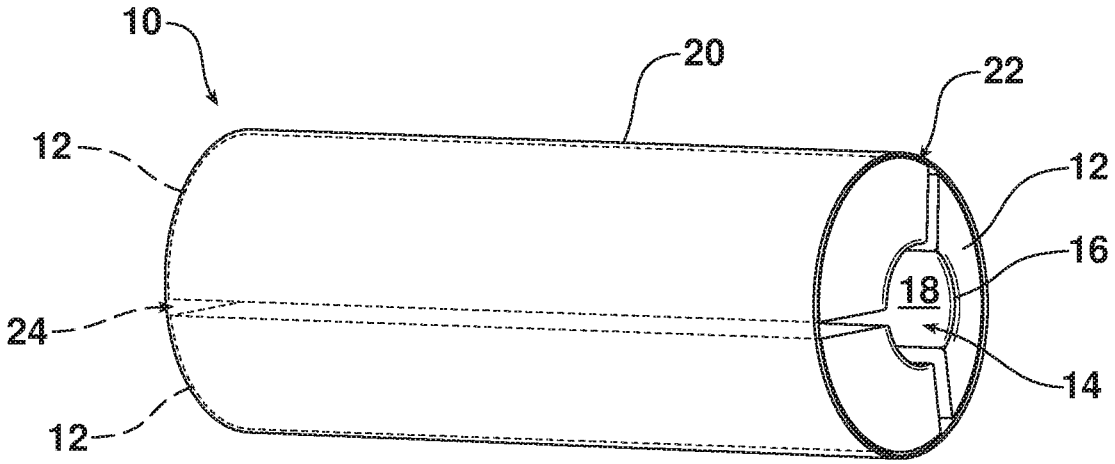
FIG. 1 is a is a perspective view of a device for removing debris from a metal wire.
Figure 2:
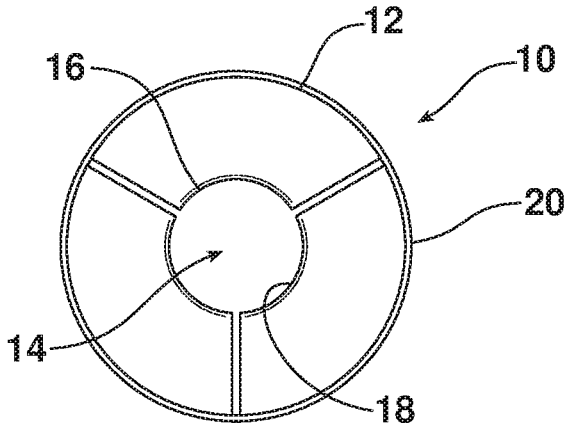
FIG. 2 is an end plan view of the device for removing debris from a metal wire.

Reference is now made to FIGS. 1 and 2 which together illustrate a device 10 for removing debris from a metal wire (W) formed by a process utilizing a lubricant. The device 10 includes three segments 12 forming a substantially tubular passage 14 through which the metal wire (W) passes in the described embodiment. Each of the three segments 12 has a leading edge 16 for stripping debris from the metal wire. While the leading edges 16 of the segments 12 substantially conform to an outer diameter of the metal wire (W) as shown in FIG. 2, the noted passage 14 formed by the three segments 12 can take many shapes so long as the metal wire can pass through the device 10.

Figure 3:
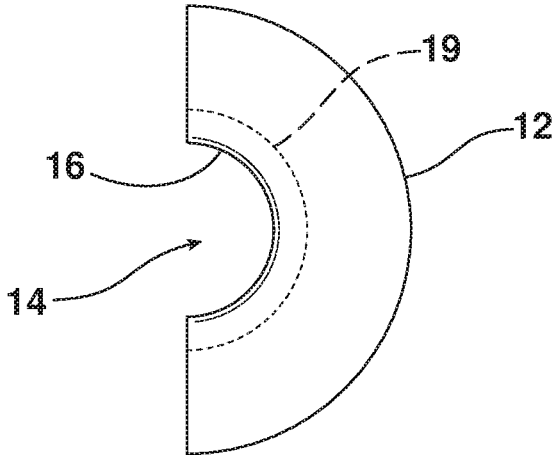
FIG. 3 is a cross sectional view of a segment of an alternate embodiment of a device for removing debris from a metal wire showing a liner forming an inner surface of a passage formed by two segments of the device.

In the described embodiment, an inner surface 18 of each of the three segments 12 substantially conforms to the outer diameter of the metal wire (W). In one alternate embodiment shown in FIG. 3, the inner surface 18 may be an inner surface of a wear resistant or plastic liner 19 attached to each of the three segments. Such wear resistant materials or plastics offer protection from surface marring and scratching, reduction in noise through contact with the passing metal wire, and offer oxidation and corrosion resistance. The leading edge 16 of each segment could form a portion of the segment 12 or the wear resistant liner.

As further shown in FIG. 1, the leading edges 16 are each small radiuses. In alternate embodiments, the leading edges could be larger radiuses, no, or substantially no, radiuses, or the leading edges could be angled forward or backward forming positive and negative breaks against the flow of the metal wire.

A resilient member 20 (e.g., an elastic band) is positioned around the three segments 12 and applies a force thereto. The force is sufficient to cause contact between the leading edges 16 and the metal wire (W) passing through the passage 14. While contact between the leading edges 16 and the metal wire is desired, too much force resulting in scraping and/or deforming the metal wire is not. This is particularly true in instances where the metal wire includes an outer protective coating to prevent rust or provide some other function. In these instances, the force applied to the leading edges must be enough to strip debris from the metal wire but not enough to scrape the outer protective coating from the metal wire.

Although the resilient member 20 is described as an elastic band, the resilient member could be a spring or like device so long as the spring or like device is sufficient to apply the force. For example, the resilient member could be a spring, an O-ring, a snap ring, or a spring clamp, etc. Each type of resilient member 20 could slide over an end 22 of the device 10 or could wrap around the device. If wrapped around the device, the resilient member may include a connector (not shown) to connect first and second ends of the resilient member (e.g., snap ring ends) together, or the first and second ends could be tied together (e.g., elastic bands) or otherwise bound. Even more, the resilient member 20 could include one or more resilient members (e.g., two springs, or a snap ring and a spring, etc.)

In another alternate embodiment, the three segments 12 may be replaced with two or more segments similarly shaped to form the passage 16 through which the metal wire (W) passes. As indicated above, each segment includes a leading edge 14 for stripping debris, and shaped to conform to a portion of the outer diameter of the metal wire (W). The closer the leading edges come to approximating the outer diameter of the metal wire, the more efficient the leading edges will be at stripping debris. Even more, the smaller the gaps 24 between segments, the more efficient the stripping.

In the alternate embodiment shown in FIG. 4, each of the three segments have a leading edge 30 for stripping debris from a metal wire (W) and first and second side edges. A first side edge 32 of a first segment 34 is connected to a second side edge 36 of a second segment 38 and a gap 40 between a second edge 42 of the first segment 34 and a first edge 44 of a third segment 46 opens wide enough to allow the metal wire (W) to pass therethrough for positioning of the metal wire within a passage 48. In this embodiment, the first side edge 32 of the first segment 36 and the second side edge 36 of the second segment 38 are hingedely connected. The same is true of the edges between the second segment 38 and the third segment 46. Even more, the force applied by the resilient member (not shown) when wrapped around the device 28 closes the gap 40 after the metal wire (W) is secured in positioned within the passage 48 and causes contact between at least the leading edges 30 of the three segments 34, 38, and 46 and the metal wire (W) passing through the passage 48.

In other words, the segments forming the device are connected one to another except for a gap between edges of two of the segments, whether there are two segments or eight segments, in a clam shell type manner. In this manner, the gap between edges can be widened by temporarily overcoming the force of the resilient member (or positioning the wire within the passage of the device before positioning the resilient member) to allow the metal wire to pass therethrough for positioning of the metal wire within the passage.

The steps utilized in the method of the described embodiment are described with reference to FIG. 5. The process shown in FIG. 5 to illustrate the method is a thermal spraying process although the described method may be used in any process requiring the use metal wire. Thermal spraying is a general phrase for a group of processes that utilize a heat source to melt material in powder, wire or rod form. In this instance, the material is a metal wire 60. The molten or semi-molten material 62 is propelled by a spray gun 64, attached to an air source 66 and a power source 68, toward a prepared surface (S) by expanding process gases. The particles quench rapidly upon impact with the surface (S) and bond with the part (P).

In accordance with the method of removing debris from a metal wire formed by a process utilizing a lubricant, metal wire 60 is moved through a passage 70 of a device 72 formed by a plurality of segments 74. As shown by action arrows A, the metal wire 60 is pulled from a spool 76 hung from a spool rack 78. In alternate embodiments, the metal wire could be pulled from a barrel or a spool positioned on a floor or otherwise.

In a next step, a leading edge 80 of each of the plurality of segments 74 contacts the metal wire 60 moving through the passage 70 of the device 72. A force is applied, in another step, to the plurality of segments 74 by a resilient member 76 to cause the contact between the leading edge of each of the plurality of segments and the metal wire. A container 82 is provided for collecting the debris removed from the metal wire 60.

In the described embodiment, the container 82 is positioned beneath the leading edges 80 of the plurality of segments 74 where contact with the wire 60 occurs. In this arrangement, the metal wire 60 is pulled in a direction horizontal to the floor (F) allowing the debris to fall into the container (show by action arrow B) and not onto or into other element used in the process. Although not optimal, the wire may also be pulled in a vertical or angled direction as well.

Following the step of moving the metal wire through the passage formed by the plurality of segments, the wire 60 is moved, or pulled, through at least one wire straightener 84. Positioning the wire straightener 84 downstream of the device 72 minimizes the buildup of debris from the metal wire 60 within the wire straightener 84 as the debris is generally removed by moving the wire through the passage. Of course, in alternate embodiments, the wire straightener could be positioned upstream of the passage.

In the described embodiment, the passage 70 formed by the plurality of segments 74 is fixed in position through abutment with the straightener 84. As the metal wire 60 is pulled through the passage 70 and the straightener 84, the device 72 is similarly pulled by friction created through contact between the metal wire 60 and the plurality of segments 74 toward the straightener. As the straightener 84 is fixed in a stationary position, the device 72 is likewise stationary. As described above, the metal wire 60 is pulled in a direction horizontal to the floor (F) in the described arrangement.

Upon exiting the straightener 84, the wire 60 is pulled through a flexible tube 86 or conduit toward the spray head 64. In the described embodiment, an electric drive 88 using pinch rollers within the spray head 64 is used to pull the metal wire 60 from the roll 76, through the device 72 and wire straightener 84 and into the spray head. An external drive may be used, in an alternate embodiment, to pull the metal wire. For example, any pneumatic, hydraulic, or electric drive can be used to move or pull the metal wire. Within the spray head 64, the metal wire 60 is melted and sprayed on a surface (S) of a part (P) as generally described above with regard to the thermal spraying process. The flexible tube 86 or conduit maintains the metal wire 60 in a debris free state after the device 72 has stripped debris from the metal wire.

In summary, numerous benefits result from the method of method of removing debris from a metal wire formed by a process utilizing a lubricant, are illustrated in this document. The method is capable of providing a simple and inexpensive way to overcome issues related to the use of lubricants in the wire drawing process used to form metal wire. In this instance, the debris adhered to the metal wire due to the presence of the lubricant can be stripped from the metal wire using a simple device. Even more, the stripping device is designed in one embodiment such that the metal wire being stripped is not required to be threading through the device.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A device for removing debris from a metal wire formed by a process utilizing a lubricant, comprising:

at least two segments forming a passage adapted to receive the metal wire, each of the at least two segments having a leading edge adapted for stripping debris from the metal wire; and a resilient member positioned around a circumference of the at least two segments and applying a force to the at least two segments sufficient to cause contact between the leading edges and at least the debris on the metal wire passing through the passage whereby the debris is stripped from the metal wire.

2. The device for removing debris from a metal wire formed by a process utilizing a lubricant of claim 1, wherein the at least two segments form a substantially tubular passage.

3. The device for removing debris from a metal wire formed by a process utilizing a lubricant of claim 2, wherein the leading edge of each of the at least two segments substantially conforms to an outer diameter of the metal wire.

4. The device for removing debris from a metal wire formed by a process utilizing a lubricant of claim 2, wherein an inner surface of each of the at least two segments substantially conforms to an outer diameter of the metal wire.

5. The device for removing debris from a metal wire formed by a process utilizing a lubricant of claim 4, wherein the inner surface of each of the at least two segments is a wear resistant material attached to each of the at least two segments.

6. The device for removing debris from a metal wire formed by a process utilizing a lubricant of claim 1, wherein the leading edge for stripping debris from the metal wire is in the shape of one of a small radius, a large radius, substantially no radius, a positive break, or a negative break.

7. The device for removing debris from a metal wire formed by a process utilizing a lubricant of claim 1, wherein the metal wire includes an outer protective coating and the force applied to the at least two segments is insufficient to scrape the outer protective coating from the metal wire.

8. The device for removing debris from a metal wire formed by a process utilizing a lubricant of claim 1, wherein the resilient member is one of a spring clamp, a snap ring, an O-ring, a spring, or an elastic band.

9. The device for removing debris from a metal wire formed by a process utilizing a lubricant of claim 1, wherein first and second ends of the resilient member are connected to create the force applied to the at least two segments.

10. The device for removing debris from a metal wire formed by a process utilizing a lubricant of claim 9, wherein the leading edge of each of the at least two segments substantially conforms to an outer diameter of the metal wire.

11. The device for removing debris from a metal wire formed by a process utilizing a lubricant of claim 10, wherein the resilient member is one of a spring clamp, a snap ring, an O-ring, a spring, or an elastic band.

* * * * *